United States Patent [19]

Wattley

[11] Patent Number: 4,715,197

[45] Date of Patent: Dec. 29, 1987

[54] CLAMP ASSEMBLY

[75] Inventor: Mark D. Wattley, Louisville, Ky.

[73] Assignee: General Electric Company, Louisville, Ky.

[21] Appl. No.: 28,878

[22] Filed: Mar. 23, 1987

[51] Int. Cl.[4] ..... F25B 39/02

[52] U.S. Cl. ..... 62/515; 248/232; 62/298; 165/67

[58] Field of Search ..... 62/515, 298; 248/232, 248/233; 165/67, 68

[56] References Cited

U.S. PATENT DOCUMENTS

| | | | |
|---|---|---|---|
| 341,710 | 5/1886 | White . | |
| 2,547,349 | 4/1951 | Tegarty | 24/137 |
| 3,056,182 | 10/1962 | Gary et al. | 24/259 |
| 3,282,657 | 11/1966 | Bright | 29/183.5 |
| 3,600,764 | 8/1971 | Froehlich, Jr. | 24/137 R |

*Primary Examiner*—Henry A. Bennet
*Attorney, Agent, or Firm*—Frederick P. Weidener; Radford M. Reams

[57] ABSTRACT

A clamp assembly including a tubular elongated member having a portion of its circumference relatively smooth and a portion having a fin array comprising fins formed along a base line of the tubular elongated member. The fins extend radially outward from their attachment to the elongated member and are bent alternately to diverge away from each other. A clamp device having a base and at one end from the base it is fastened to a structural panel member and the other end from the base has two legs with a first portion spaced apart a distance sufficient to receive the tubular elongated member therebetween. The legs have a second portion diverging outwardly from the first portion, a third portion reversely bent relative to the second portion and forming inwardly directed resilient fingers converging toward the base and each other with the fingers having free ends and inwardly directed projections located near the free end. The tubular elongated member is received between the two spaced apart legs of the clamp and retained therein by the fingers of the third portion with the projections positioned between the alternately bent fins in close proximity to the base line of the tubular elongated member.

7 Claims, 5 Drawing Figures

FIG. 3
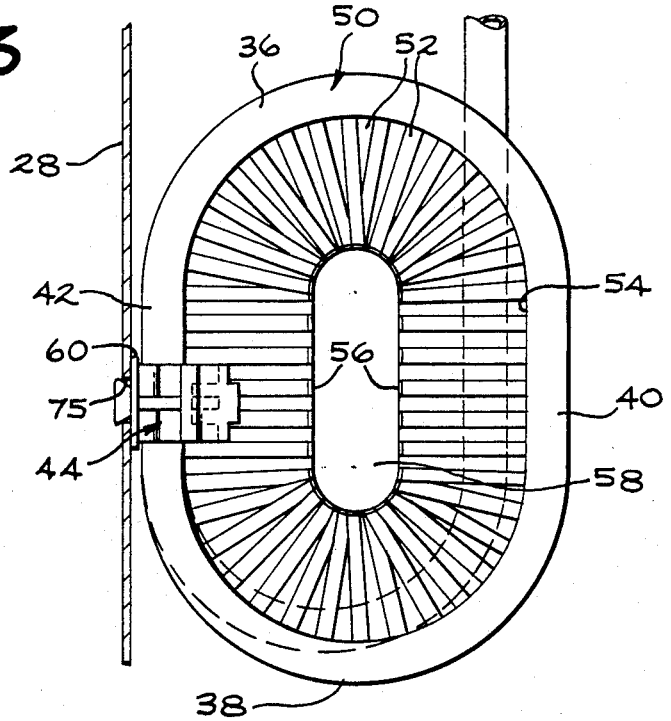
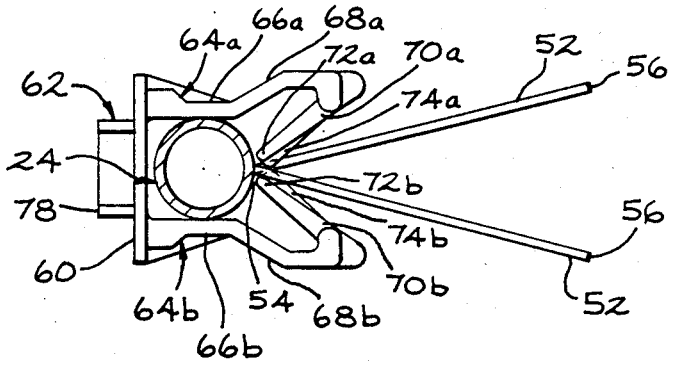
FIG. 4
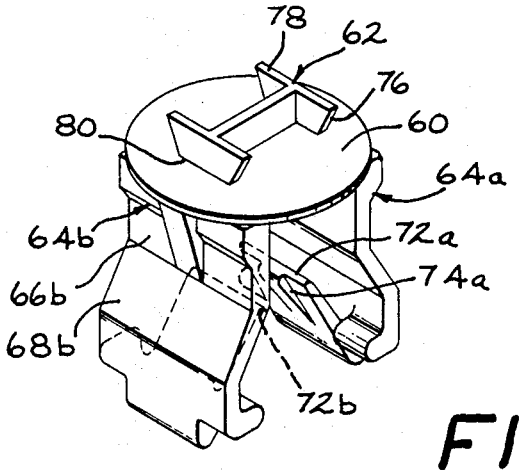
FIG. 5

CLAMP ASSEMBLY

BACKGROUND OF THE INVENTION

This invention relates to a clamp assembly and in particular a clamp assembly for securing an evaporator in a household refrigerator. More specifically, the clamp assembly is to prevent both horizontal and vertical movement of helically formed heat exchange tubing which comprises the evaporator once it is installed in a household refrigerator.

Clamp assemblies similar to the clamp assembly described and shown in the present application have been used to hold evaporators in their proper horizontal position and particularly helically formed coil type evaporators having two coil sections mounted side-by-side horizontally and spaced slightly apart from each other. In such evaporator mounting arrangements it is common to mount the side-by-side coils on a mounting plate which is then attached to an inner panel of a refrigerator compartment by screw means located between the spaced apart coil sections. In such evaporator arrangements it is also common to have an electric resistance defrost heater assembly located in close proximity to the bottom coil section so that during the defrost cycle the heater will be energized and melt the frost which has accumulated on the evaporator. One of the difficulties in using the prior clamp assembly is that while they were suitable to prevent horizontal movement of the helically coiled evaporator, they did not prevent vertical movement which would allow the coil sections to sag or move downwardly from their intended mounting position and cover up the screw holes for mounting the mounting plate to the inside of the refrigerator, thus making installation of the evaporator component in the refrigerator very difficult. The bottom helically wound coil section could also sag and in some cases come into contact with the defrost heater assembly and detrimentally affect the defrost heater assembly.

It is common to have the evaporator housed in a compartment separated from the freezer compartment by a large panel forming the back wall of the freezer compartment. This panel is in close proximity to the evaporator and sagging of the coil sections can cause the evaporator to contact the back wall panel of the freezer compartment. Evaporators have an inherent noise vibration due to high pressure gases passing through them and if an evaporator is in contact with the panel forming the back wall of the freezer compartment, it tends to act as an acoustic radiator and undesirably amplifies the noise.

By this invention there is an improved clamp assembly that prevents both horizontal and vertical movement of the helically wound coil evaporator after it has been attached to a mounting plate and eliminates the above-mentioned deficiencies of prior art mounting assemblies.

SUMMARY OF THE INVENTION

There is provided a clamp assembly comprising a tubular elongated member having a portion of its circumference relatively smooth and a portion having a fin array comprising fins formed along a base line of the tubular elongated member. The fins extend radially outward from their attachment to the elongated member and are bent alternately to diverge away from each other. A clamp device having a base with means at one end from the base to fasten the clamp device to a structural panel member and the other end from the base has two legs, said legs having a first portion spaced apart a distance sufficient to receive the tubular elongated member therebetween. The legs have a second portion diverging outwardly from the first portion, a third portion reversely bent relative to the second portion and forming inwardly directed resilient fingers converging toward the base and each other. These fingers have free ends and an inwardly directed projection located near the free end. The tubular elongated member is received between the two spaced apart legs of the clamp device and retained therein by the fingers of the third portion with the projections positioned between the alternately bent fins in close proximity to the base line of the tubular elongated member.

BRIEF DESCRIPTION OF THE DRAWINGS

FIG. 3 is an enlarged view of a portion of the refrigerator of FIGS. 1 and 2 taken along line 3—3 of FIG. 1.

FIG. 4 is a side elevational view partially in section showing one form of the present invention.

FIG. 5 is a perspective view of the clamp device of the present invention.

DESCRIPTION OF THE PREFERRED EMBODIMENT

Figure 1:
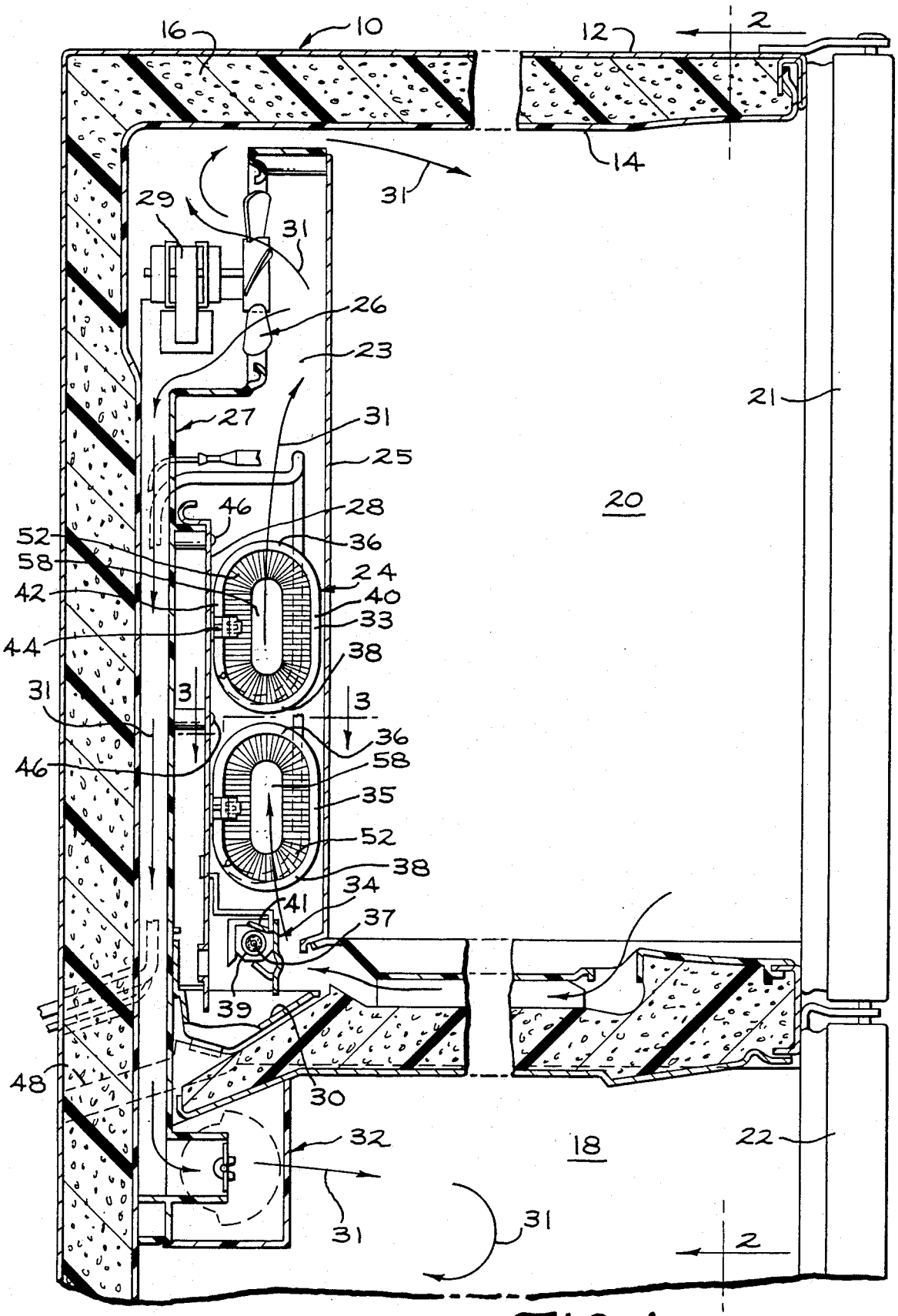
FIG. 1 is a side elevational view in cross-section of a household refrigerator including one form of the present invention.
Figure 2:
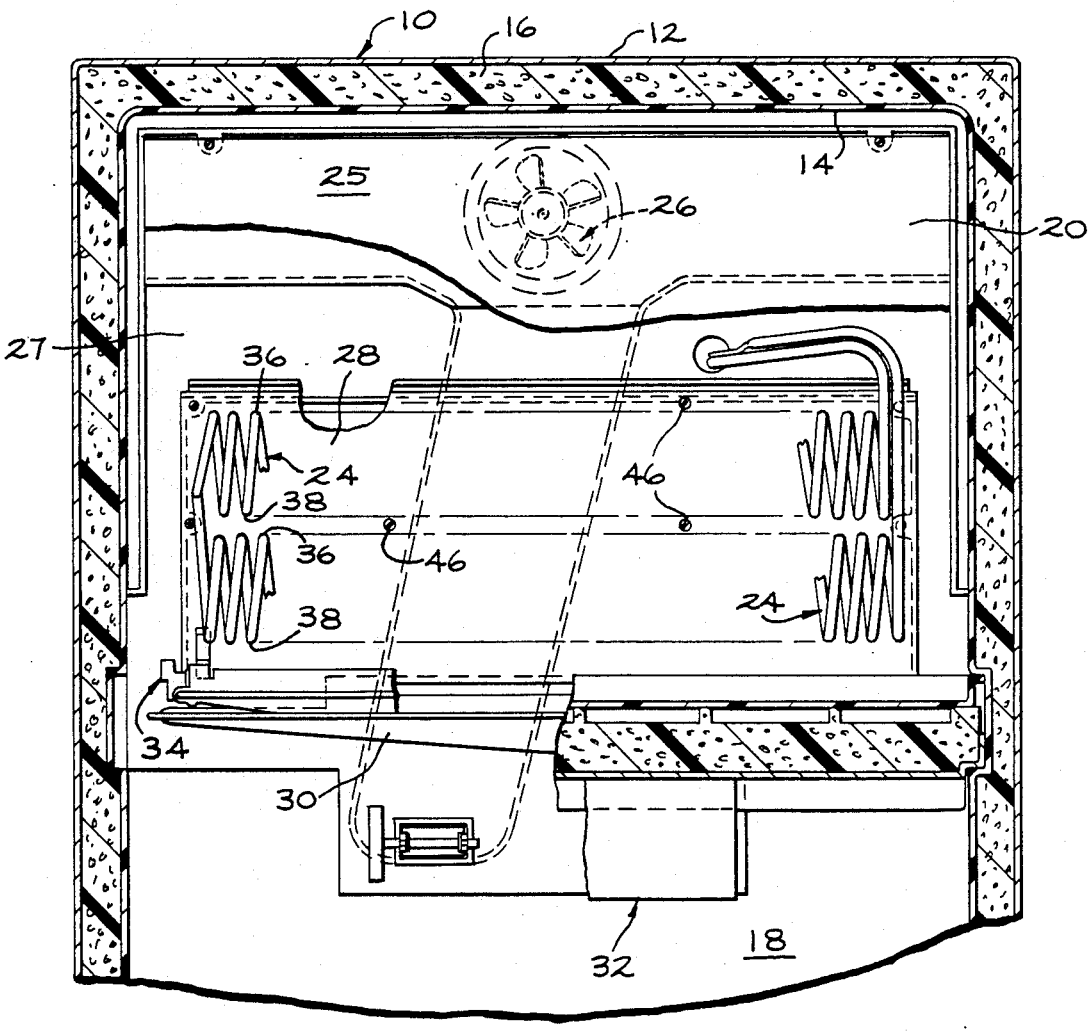
FIG. 2 is a front elevational view in cross-section of the household refrigerator of FIG. 1 taken along line 2—2.

With reference particularly to FIGS. 1 and 2, there is shown a refrigerator cabinet 10 which includes an outer shell 12 and an inner liner 14 spaced from the outer wall. The space between the outer shell and inner liner is filled with thermal insulation 16 in a conventional manner.

Formed within the interior of the refrigerator cabinet are a first compartment 18 positioned in the bottom portion of the cabinet and a second compartment 20 positioned in a top portion of the cabinet. The compartment 18 is to be maintained at a temperature above freezing for the storage of fresh food and the compartment 20 is to be maintained at a temperature below freezing for the storage of frozen foods. There is an access door 21 to the freezer compartment 20 and a fresh food compartment access door 22. At the rear of the freezer compartment 20 there is an evaporator compartment 23 for housing the evaporator 24 with a panel 25 separating the evaporator compartment 23 from the freezer 20. The rear wall 27 of the evaporator compartment is the main support housing on which the evaporator 24 and fan 26 are mounted. The fan 26 is driven by a motor 29 which will cause air to flow in both the freezer compartment 20 and the fresh food compartment 18. The general pattern of the air flow through the compartments are shown by arrows designated 31. The evaporator 24 is a helically coiled tubular elongated member which in the preferred embodiment is shown as having a top horizontal helical coil section 33 and a bottom helically coiled horizontal section 35 spaced a small distance below the top section 33. As can be seen in FIGS. 1 and 3 the coil of the evaporator in cross-section resembles a race track having curved ends 36 and 38 with straight sections 40 and 42 integrally formed with the curved ends 36 and 38. The evaporator 24 as shown in FIG. 1 has the top coil section 33 and bottom coil section 35 secured to a plate or structural panel member 28 as by clamp devices 44. The evaporator 24 is secured to the structural panel member 28 as a sub-assembly during the manufacture of the refrigerator and then is subsequently installed in the evaporator compartment by screw fasteners 46 which are secured through the structural panel member 28 into the rear wall 27 or main support housing.

Below the evaporator 24 is a defrost heater assembly 34 which runs parallel to the bottom coil section 35 and in the preferred embodiment the defrost heater is a coiled electric resistance wire 37 sheathed by a glass tube 39 and is electrically energized to supply heat which will defrost the evaporator at timed intervals. Just above the glass tube 39 is a thin metal deflector 41 and beneath the defrost heater 34 is a drain pan member 30 into which the defrost condensate is deposited and removed from the interior of the refrigerator by a conduit 48.

With reference particularly to FIGS. 1 and 3, the tubular elongated member 24 has a portion of its tube circumference relatively smooth such as normal aluminum tubing and is designated as 50 in FIG. 3. A portion of the tubular elongated member has a fin array comprising fins 52 formed along a base line 54 of the tubular elongated member 24 and these fins extend radially outward from their attachment along the base line 54 and radially inward along the length of the helical coiled sections. The fins are bent alternately to diverge away from each other as particularly seen in FIG. 4. When the tubular elongated member 24 is formed into a coil as shown in FIGS. 1 and 3 the free ends 56 of the fins 52 terminate short of contacting the opposite free ends of the fins to provide a tunnel passage 58 at the center of each of the coil sections.

To hold the evaporator tubular elongated member 24 in its proper location on structural panel member 28 there are clamp devices 44 which grip the tubular elongated member at one end of the clamp device and the other end of the clamp device is fastened to the structural panel member 28. With reference particularly to FIGS. 4 and 5, the clamp device has a base 60 with securing means 62 at one end from the base to fasten the clamp device to the structural panel member 28. At the other end from the base 60 are two spaced apart legs **64*a* and 64*b* and these legs have a first portion 66*a* and 66*b* spaced apart a distance sufficient to receive the tubular elongated member 24 therebetween. A second portion 68*a* and 68*b* diverges outwardly from the first portion and a third portion 70*a* and 70*b* is reversely bent relative to the second portion and forms inwardly directed resilient fingers which converge toward the base 60 and each other. These fingers 70*a* and 70*b* have free ends 72*a* and 72*b* and have inwardly directed projections 74*a* and 74*b*** located near the respective free ends. The clamp device may be molded from suitable plastic material.

To secure the tubular elongated member or evaporator 24 to the structural panel member 28 there are rectangular shaped apertures 75 (FIG. 3) formed in the panel member and the securing means 62 of the clamp device 44 comprises a pyramidal shaped portion 76 having a base 78 and a truncated area 80 which is attached to the base 60 so that the side walls of the pyramidal shaped portion 76 slant inwardly from the base 78 of the pyramidal shaped portion toward the base 60 of the clamp device as seen in FIG. 5. The rectangular apertures 75 formed in the structural panel member 28 have two opposite sides spaced further apart than the pyramidal shaped portion base 78 and two sides spaced closer together than the pyramidal shaped portion base 78 whereby inserting the pyramidal shaped portion 76 into the aperture and rotating the clamp device the pyramidal shaped portion 76 cooperates with the edges of the closer spaced two sides of the aperture 75 to hold them in frictional engagement. After the clamp devices 44 have been secured to the structural panel member 28 the lateral cross-section of the preformed tubular elongated member or evaporator 28 is forced into the clamp device by moving the smooth portion 50 thereof against the inwardly directed third portion or fingers **70*a* and 70*b* which will spread apart and allow the tubular elongated member to pass beyond the fingers down into the spaced apart first portion 66*a* and 66*b* and is captured therebetween and held in position by the third portion or fingers 70*a* and 70*b* as best shown in FIG. 4. In this position the projections 74*a* and 74*b* engage the spaces between the alternately bent fins 52 in close proximity to the base line 54** of the tubular elongated member.

With the above-described arrangement the evaporator 28 is prevented from both horizontal movement and vertical movement as viewed in FIG. 2. This is important because clamps used heretofore did not assure that there would be no vertical movement of the evaporator 28. The problems created by that lack of design function could cause the tubular elongated member such as the coil sections 33 and 35 to sag from their position as shown in FIG. 2. The reason that these coil sections could sag is that while the clamp device prevented horizontal movement it will be noted that the clamp device is in the middle of the straight section 42 of the coil sections and because of the smooth surface 50 the coil sections 33 and 35 could slip downwardly through the clamp device 44 and in some cases would even be rotated slightly (counterclockwise as viewed in FIG. 3) as a small portion of the curved ends 36 slipped through the clamp device 44. This sagging presents three problems. If the top coil section 33 sags due to this slippage of the tubular elongated member 24 through the clamp device 44, it covers up the holes in the structural panel member 28 provided for securing the sub-assembly to the main support housing 27 by fasteners 46, thus making installation of the evaporator very difficult. If the bottom helical coil section 35 slips in the same manner and comes in contact with the defrost heater assembly 34, it can detrimentally affect the defrost heater assembly 34. It will also be noted that coil sections 33 and 35 are in close spaced proximity to the panel 25 and as mentioned previously the coil sections have a tendency to rotate when a small portion of the curved ends 36 slip through the clamp device 44 which cause the coil sections to touch the panel 25. In refrigeration systems the evaporator has an inherent vibration that causes noise due to the high pressure gases passing through the evaporator so the evaporator acts as an acoustic radiator, which noise vibration is amplified when the coil sections touch the large metal panel 25 thus producing a noisy refrigeration system which is unpleasant to the user. By utilizing the clamp device 44 of the present invention the projections **74*a* and 74*b* prevent any vertical movement of the tubular elongated member or evaporator 24 from the position as it is shown in FIGS. 1–3 by the projections gripping the tubular elongated member between the alternately bent fins and therefore retains the evaporator 24** in its proper position during the assembly of the refrigerator and subsequently to prevent both damage to defrost heater assembly and amplified noise vibrations.

The foregoing is a description of the preferred embodiment of the invention and it should be understood that variations may be made thereto without departing from the true spirit of the invention as defined in the appended claims.

What is claimed is:

1. A clamp assembly comprising:

a tubular elongated member having a portion of its circumference relatively smooth and a portion having a fin array comprising fins formed along a base line of the tubular elongated member, said fins extending radially outward from their attachment to the elongated member and bent alternately to diverge away from each other;

a clamp device having a base with securing means at one end from the base to fasten the clamp device to a structural panel member, two spaced apart legs at the other end from the base, said legs having a first portion spaced apart a distance sufficient to receive the tubular elongated member therebetween, a second portion diverging outwardly from the first portion, a third portion reversely bent relative to the second portion and forming inwardly directed resilient fingers converging toward the base and each other, said fingers having free ends and an inwardly directed projection located near the free end; and said tubular elongated member being received between the two spaced apart legs of the clamp device and retained therein by the fingers of the third portion with said projections positioned between the alternately bent fins in close proximity to the base line of the tubular elongated member.

2. The clamp assembly of claim 1 wherein the tubular elongated member is a generally helical coil heat exchanger tube for a refrigerator with the turns of the coil being spaced apart and the fins extend inwardly in the general direction of the radius of the coil turns.

3. The clamp assembly of claim 1 wherein the means at one end from the base to fasten the clamp device to a structural panel member comprises a pyramidal shaped portion having a base and truncated area with the truncated area attached to the base of the clamp device and the structural panel member has a generally rectangular aperture having two opposite sides spaced further apart than the pyramidal shaped portion base and two sides spaced closer together than the pyramidal shaped portion base whereby inserting the pyramidal shaped portion into the aperture and rotating the clamp device the pyramidal shaped portion cooperates with the edges of the closer spaced two sides of the aperture to hold the pyramidal shaped portion in frictional engagement.

4. The clamp assembly of claim 1 wherein the clamp device is molded from plastic material.

5. A refrigerator evaporator unit comprising:

an evaporator including a helically coiled tubular elongated member having a plurality of axially spaced coil turns with a first section and a second coil section in side-by-side horizontal relationship secured to a structural panel member, said tubular elongated member having a portion of its circumference relatively smooth and a portion having a fin array comprising fins formed along a base line of the tubular elongated member, said fins extending radially outward from their attachment to the elongated member and radially inward along the length of the helical coil sections and the fins are bent alternately to diverge away from each other;

a clamp device having a base with securing means at one end from the base to fasten the clamp device to the structural panel member, two spaced apart legs at the other end from the base, said legs having a first portion spaced apart a distance sufficient to receive the tubular elongated member therebetween, a second portion diverging outwardly from the first portion, a third portion reversely bent relative to the second portion and forming inwardly directed resilient fingers converging toward the base and each other, said fingers having free ends and an inwardly directed projection located near the free end; and said tubular elongated member being received between the two spaced apart legs of the clamp device and retained therein by the fingers of the third portion to prevent horizontal movement of the helically coiled tubular elongated member relative to the clamp device and with said projections positioned between the alternately bent fins in close proximity to the base line of the tubular elongated member to prevent vertical movement of the helically coiled tubular elongated member relative to the clamp device.

6. The clamp assembly of claim 5 wherein the means at one end from the base to fasten the clamp device to a structural panel member comprises a pyramidal shaped portion having a base and truncated area with the truncated area attached to the base of the clamp device and the structural panel member has a generally rectangular aperture having two opposite sides spaced further apart than the pyramidal shaped portion base and two sides spaced closer together than the pyramidal shaped portion base whereby inserting the pyramidal shaped portion into the aperture and rotating the clamp device the pyramidal shaped portion cooperates with the edges of the closer spaced two sides of the aperture to hold the pyramidal shaped portion in frictional engagement.

7. The clamp assembly of claim 5 wherein the clamp device is molded from plastic material.

* * * * *